US006471731B1

(12) United States Patent
Elliott, III et al.

(10) Patent No.: US 6,471,731 B1
(45) Date of Patent: Oct. 29, 2002

(54) POLYMERIC CANDLE COMPOSITIONS AND CANDLES MADE THEREFROM

(75) Inventors: David Elliott, III, Pearland, TX (US); Richard L. Johnson, Batavia, IL (US); Wei Song, Houston, TX (US)

(73) Assignee: Penreco, Houston, TX (US)

( * ) Notice: Subject to any disclaimer, the term of this patent is extended or adjusted under 35 U.S.C. 154(b) by 0 days.

(21) Appl. No.: 09/590,863

(22) Filed: Jun. 9, 2000

Related U.S. Application Data

(60) Provisional application No. 60/148,614, filed on Aug. 12, 1999.

(51) Int. Cl.[7] ..... C10L 5/00
(52) U.S. Cl. ..... 44/275; 431/288
(58) Field of Search ..... 44/275; 431/288

(56) References Cited

U.S. PATENT DOCUMENTS

| | | | | |
|---|---|---|---|---|
| 3,645,705 A | | 2/1972 | Miller et al. | |
| 3,744,957 A | | 7/1973 | Wright, Sr. | |
| 3,819,342 A | * | 6/1974 | Gunderman | 44/275 |
| 4,005,978 A | | 2/1977 | Calabretta et al. | |
| 4,118,203 A | | 10/1978 | Beardmore et al. | |
| 4,507,077 A | | 3/1985 | Sapper | |
| 4,568,270 A | | 2/1986 | Marcus et al. | |
| 4,759,709 A | | 7/1988 | Luken, Jr. et al. | |
| 5,132,355 A | | 7/1992 | Nahlovsky | |
| 5,508,334 A | | 4/1996 | Chen | |
| 5,578,089 A | | 11/1996 | Elsamaloty | |
| 5,843,194 A | | 12/1998 | Spaulding | |
| 5,879,694 A | | 3/1999 | Morrison et al. | |
| 5,961,967 A | | 10/1999 | Powell et al. | |
| 6,096,102 A | | 8/2000 | Matthai et al. | |

FOREIGN PATENT DOCUMENTS

| | | | |
|---|---|---|---|
| WO | WO 97/29842 | | 8/1997 |
| WO | 9817243 | * | 4/1998 |
| WO | WO 98/38981 | | 9/1998 |
| WO | WO 99/27042 | | 6/1999 |
| WO | WO 99/27043 | | 6/1999 |

OTHER PUBLICATIONS

International Search Report, Jan. 17, 2001.
Encyclopedia of Chemical Technology, John Wiley & Sons, vol. 25, 4$^{th}$ Edition, pp. 614–626 Date Unknown.

* cited by examiner

*Primary Examiner*—Cephia D. Toomer
(74) *Attorney, Agent, or Firm*—Jenkens & Gilchrist A Professional Corporation

(57) ABSTRACT

A polymeric candle which undergoes a phase transition from opaque to transparent when lit is described. Methods of making such candles also are described. The candle is formed from a candle composition which includes a wax and a polymeric material. The candle composition has a phase transition temperature of about 35° C. or higher. The candle composition is substantially opaque at a temperature below the phase transition temperature, whereas it becomes substantially transparent at or above the phase transition temperature. In addition to the wax and the polymeric material, the candle composition may further include a hydrocarbon oil or mixtures thereof, such as a white oil and/or a poly-α-olefin.

68 Claims, 4 Drawing Sheets

(4 of 4 Drawing Sheet(s) Filed in Color)

POLYMERIC CANDLE COMPOSITIONS AND CANDLES MADE THEREFROM

CROSS REFERENCE TO RELATED APPLICATIONS

The application claims priority to U.S. Provisional Application Serial No. 60,148,614, entitled "Polymeric Candle Composition and Candles Made Therefrom," filed on Aug. 12, 1999.

FIELD OF THE INVENTION

This invention relates to a polymeric candle composition and candles manufactured from the polymeric candle composition.

BACKGROUND OF THE INVENTION

Candles have been used by mankind for centuries. There are various types of candles. A common type of candles that sees widespread use consists of a wick embedded in predominantly a block of paraffin wax which provides the fuel for burning the candle. The paraffin wax used in candles typically is highly refined and crystalline at room temperature. Crystalline paraffin is naturally white. Therefore, candles made from crystalline paraffin wax generally are opaque.

In addition to opaque candles, some transparent or clear candles have become available. For example, transparent candles may be made from a composition that includes a thermoplastic polyamide resin and a flammable solvent which is capable of solubilizing the resin at temperatures below about 212° F. The flammable solvent also is capable of forming a transparent-gel type structure with the resin. The flammable solvent may be selected from unsaturated fatty acids, unsaturated fatty alcohols, saturated fatty alcohols, esters of fatty acids with polyhydric alcohols and glycerol, and mixtures thereof Other transparent gel formulations also have been developed over the past decades.

While the burning of a candle might appear to be simple and uninvolved, the process that takes place in the burning of a candle imposes rather stringent requirements upon the candle body material. For instance, the candle body should be rigid enough to support itself or be supported in a container; but it should not be excessively brittle at low room temperatures. During burning, the heat of the candle flame melts a small pool of the candle body material around the base of the exposed portion of the wick. This molten material is drawn up through and along the wick by capillary action to fuel the flame. The melting point of a candle material generally is important because the candle material should liquefy at or below temperatures to which the candle material can be raised by radiant heat from the candle flame. If the melting temperature of the candle is too low, the candle will drip or, in an extreme case, the entire candle body will melt, dropping the wick into a pool of molten candle body material, with the potential that the surface of the pool could ignite. On the other hand, if the melting point is too high, the flame will be starved because insufficient fuel will be drawn up through the wick with the result that the flame will be too small to maintain itself. When molten, the candle body material preferably should have a relatively low viscosity to ensure that it will be capable of being drawn up through the wick by capillary action. Moreover, it is preferred that the candle body material burn with a flame that is both luminous and smokeless. The odors that are produced by the combustion should not be unpleasant or intrusive.

Due to these considerations and requirements, most candle compositions generally have been limited to wax-based candles which are opaque. Although a number of transparent candles are available, candles capable of changing from opaque to substantially transparent while lit are largely unknown. Such candles would be desirable because they are aesthetically appealing and provide an alternative to the existing candles. Therefore, there is a need to explore methods to make a candle which is substantially opaque at room temperature, but turns substantially transparent when lit.

SUMMARY OF THE INVENTION

The invention meets the above need by providing a polymeric candle which is substantially opaque at room temperature; but at least a portion of the polymeric candle turns substantially transparent after it is lit. The polymeric candle is formed from a candle composition which includes a wax and a polymeric material. The wax and polymeric material are selected such that the polymeric candle composition has a phase transition temperature of about 35° C. or higher. The resulting composition is substantially opaque at a temperature below the phase transition temperature, and at least a portion of the composition becomes substantially transparent at or above the phase transition temperature. The candle composition may further include a hydrocarbon oil or mixtures thereof Preferably, the wax is a paraffin wax with at least 20 carbon atoms per molecule. The preferred polymeric material is a block copolymer that includes at least two blocks: a rigid block and an elastomeric block. Additional aspects of the invention, objects and advantages of embodiments of the invention are further described in the following.

BRIEF DESCRIPTION OF THE DRAWINGS

The file of this patent contains at least one drawing executed in color. Copies of this patent with color drawings will be provided by the Patent and Trademark Office upon request and payment of the necessary fee.

DESCRIPTION OF EMBODIMENTS OF THE INVENTION

Figure 1:
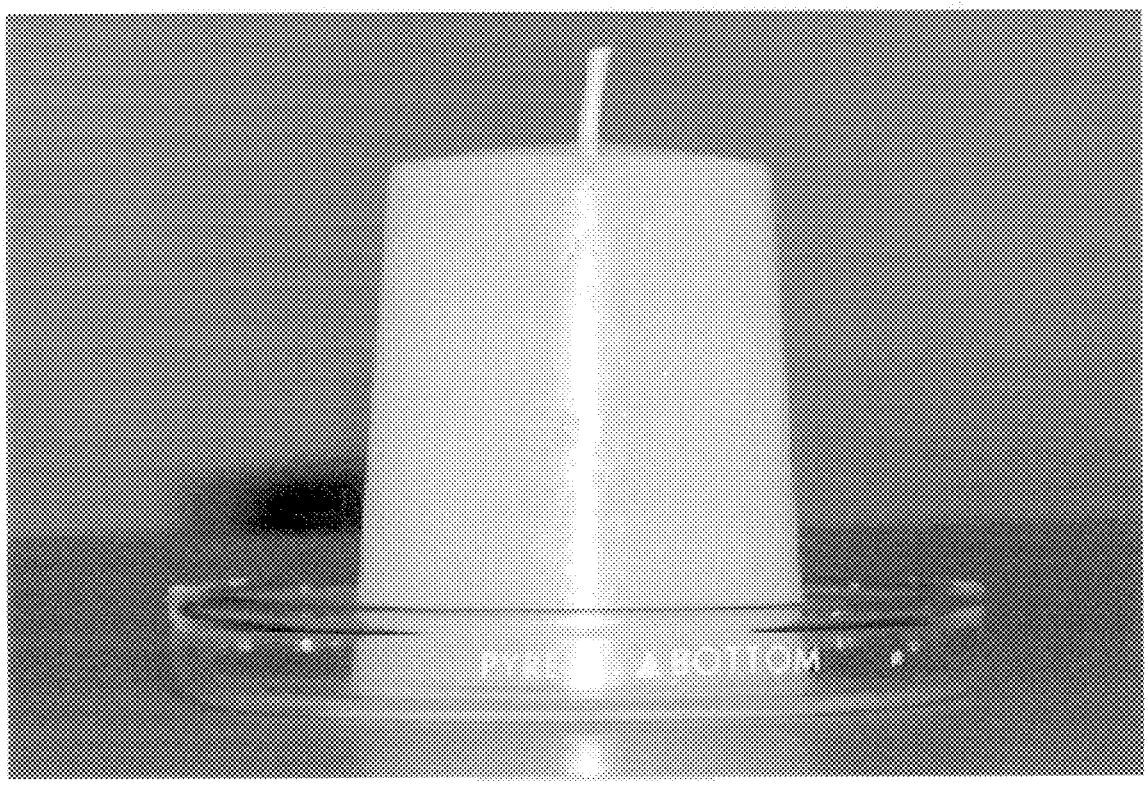
FIG. 1 is a photograph of a candle made in one embodiment of the invention. The photograph shows that the candle is opaque before it is lit.

Now it has been discovered that a candle capable of changing from opaque to transparent can be made from a polymeric candle composition. The candle can be either free-standing or contained in ajar. The polymeric candle composition includes a wax and a polymer. The wax and polymer are selected such that the resulting polymeric candle composition has a phase transition temperature of about 35° C. or higher. The polymeric candle composition is substantially opaque at a temperature below the phase transition temperature, whereas at least a portion of the polymeric candle composition becomes substantially transparent at or above the phase transition temperature.

Preferably, the phase transition temperature of the candle composition is above ambient temperature. When the phase transition temperature of a candle composition is below ambient temperature, one would have to put the candle in a relatively cold environment in order to observe the phase transition from opaque to transparent. On the other hand, when the phase transition temperature of a candle composition is above ambient temperature, the candle made from the candle composition remains opaque before it is lit. After it is lit, the heat generated by the flame slowly heats up the candle composition. When the candle temperature exceeds the phase transition temperature in one portion, that portion of the candle composition turns substantially transparent. After the temperature of the entire candle exceeds the phase transition temperature, the entire candle becomes substantially transparent. Preferably, the phase transition is reversible. In these cases, after the candle is blown out, the temperature of the candle slowly decreases. When the candle temperature in one portion of the candle falls below the phase transition temperature, that portion of the candle becomes opaque again.

The term "opaque" refers to the optical state of a medium whose molecular aggregation is such that light cannot pass through. Therefore, light transmission through an opaque medium is substantially close to zero. On the other hand, the term "transparent" refers to the optical state of a medium through which light can pass through so that a object can be seen through it. As defined, the term "transparent" includes any optical state which is not opaque. A medium is considered transparent even if only a small fraction of light passes through it. Specifically, the term "transparent" includes translucency.

Wax usually refers to a substance that is a plastic solid at ambient temperature and becomes a low viscosity liquid upon being subjected to moderately elevated temperatures. Suitable waxes include any wax which undergoes a phase transition from opaque or substantially opaque to transparent or substantially transparent. In preferred embodiments, paraffin wax with at least 20 carbon atoms per molecule (hereinafter "$C_{20+}$ paraffin wax") is used. $C_{2+}$ paraffin wax refers to a wax composed of mainly paraffins with 20 or more carbon atoms per molecule. In other words, the preferred $C_{20+}$ paraffin wax is substantially free of paraffins with less than 20 carbon atoms per molecule. Nevertheless, a small amount of paraffins with less than 20 carbon atoms per molecule may be present in the $C_{2+}$ paraffin wax. Preferably, the melting point of the $C_{20+}$ paraffin wax should fall in the range of about 100° F. to about 200° F. (i.e., about 37° C. to about 93° C.), more preferably in the range of about 100° F. to about 170° F., and most preferably in the range of about 110° F. to about 125° F. Other suitable waxes may include, but are not limited to, beeswax, animal wax, vegetable wax, mineral wax, and synthetic wax.

Paraffin wax is considered as a petroleum wax. It typically is macrocrystalline and brittle. Paraffin wax usually is composed of about 40 to about 90 weight percent of normal alkanes, with the remainder isoalkanes and cycloalkanes. Preferably, the paraffin wax does not include a substantial amount of hydrocarbons with less than 20 carbon atoms per molecule. Typical properties of paraffin wax are listed in Table I as follows. An example of suitable paraffin waxes can be obtained from Bareco under the trade name of Bareco Paraffin 120/125.

TABLE I

Typical Properties of Paraffin Wax

| | |
|---|---|
| FLASH POINT, CLOSED CUP, ° C. | 204* |
| VISCOSITY AT 98.9° C., $MM^2/S$ | 4.2–7.4 |
| MELTING RANGE, ° C. | 46–68 |
| REFRACTIVE INDEX AT 98.9° C. | 1.430–1.433 |
| NUMBER AVERAGE MOLECULAR WEIGHT | 350–420 |
| CARBON ATOMS PER MOLECULE | 20–36 |
| DUCTILITY/CRYSTALLINITY OF SOLID WAX | friable to crystalline |

*value is a minimum.

In addition to a wax, a polymer or a polymeric material is used to form the polymeric candle composition. The term "polymer" used herein includes both homopolymer and copolymer. A homopolymer is a polymer obtained by polymerizing one type of monomer, whereas a copolymer is a polymer obtained by polymerizing two or more types of monomers. "Block copolymer" refers to a copolymer in which like monomer units occur in relatively long, alternate sequences on a chain.

The polymer used in the candle composition primarily functions as a gelling agent. Any polymer which is capable of forming a three dimensional network or a gel through physical crosslinking may be used in embodiments of the invention. Preferably, suitable polymers include, but are not limited to, a copolymer with at least two blocks, i.e., a diblock copolymer, a triblock copolymer, a radial block copolymer, a star polymer, a multi-block copolymer, and mixtures thereof. In more preferred embodiments, the polymer includes at least one triblock copolymer, radial block copolymer, star polymer, or multi-block copolymer. The copolymer includes at least one rigid block and one elastomeric (or rubber-like) block. The rigid blocks of the copolymer form rigid domains through which physical crosslinking may occur. The physical crosslinking via these rigid domains yields a continuous three dimensional network. In the presence of heat and shear or solvent, the rigid domains soften and permit flow. After cooling or solvent evaporation, the rigid domains reform and harden, locking the elastomeric network in place. U.S. Pat. Nos. 5,221,534, 5,879,694 and 5,578,089 disclose examples of such block copolymers, and the disclosures of the patents are incorporated by reference in their entirety herein.

A diblock copolymer includes two blocks within its chains: a rigid block and an elastomeric block. The rigid block typically may be composed of polystyrene, polyethylene, polyvinylchloride, phenolics, and the like; the elastomeric block may be composed of ethylene/butadiene copolymers, polyisoprene, polybutadiene, ethylene/propylene copolymers, ethylene-propylene/diene copolymers, and the like. As such, suitable diblock copolymers include, but are not limited to, polystyrene/ethylene-propylene copolymers, polystyrene/ethylene-butadiene copolymers, polystyrene/butadiene copolymers and styrene-isoprene copolymers. In some embodiments, a diblock copolymer is used along with one or more triblock copolymers, star polymers, radial copolymers, and multi-block copolymers containing four or more blocks.

A triblock copolymer includes two rigid blocks at either end and a middle block which is elastomeric within its chains. This is a preferred triblock copolymer structure, although a triblock copolymer with two elastomeric end blocks and a rigid middle block also can be used. Suitable triblock copolymers include, but are not limited to, styrene-ethylene/propylene-styrene copolymers, styrene-ethylene/ butadiene-styrene copolymers, styrene-isoprene-styrene copolymers, and styrene-butadiene-styrene copolymers. Multi-block copolymers are similar to diblock copolymers or triblock copolymers, except that the multiple block copolymers include additional elastomeric blocks and/or rigid blocks.

In addition to the linear chain structure, branched homopolymers or copolymers, such as a radial polymer and a star polymer, also may be used. It should be noted that one or more functional groups may be grafted onto the chain of any of the aforementioned polymers. In other words, any of the above polymers may be modified by grafting. Suitable functional groups for grafting depend on the desired properties. For example, one or more ester groups, silane groups, silicon-containing groups, maleic anhydride groups, acrylamide groups, and acid groups may be grafted. In addition to grafting, the above polymers may be hydrogenated to reduce unsaturation before they are used.

It is noted that additional suitable block copolymers may include, but are not limited to, polystyrene/polyester, polyether/polyamide, polyether/polyester, polyester/polyamide, polyether/polyurethane, polyester/polyurethane, poly(ethylene oxide)/poly(propylene oxide), nylon/rubber, and polysiloxane/polycarbonate.

Generally, the weight average molecular weight of a suitable polymer is in the range from about 10,000 to about 1,000,000, preferably from about 70,000 to about 400,000. The rigid block content may range from about 5% to about 80%, preferably from about 20% to about 40% by weight.

Numerous commercially available block copolymers may be used in embodiments of the invention. For example, various grades of copolymers sold under the trade name of Kraton® from Shell Chemical Company can be used. In addition, copolymers sold under the trade name of Vector® available from Dexco and Septon® from Kuraray also may be used. Table II lists some commercially available block copolymers which may be used in embodiments of the invention.

TABLE II

| Copolymer | Block Type | Polystyrene Content (%) | Comment |
|---|---|---|---|
| Kraton ® G1702 | SEP | 28 | hydrogenated diblock |
| Kraton ® G 1701 | SEP | 37 | hydrogenated diblock |
| Kraton ® G 1780 | SEP | 7 | star polymer |
| Kraton ® G 1650 | SEBS | 30 | hydrogenated triblock |
| Kraton ® G 1652 | SEBS | 30 | hydrogenated triblock |
| Kraton ® D 1101 | SBS + SB | 31 | triblock and diblock mixture (85:15) |
| Kraton ® D 1102 | SBS + SB | 28 | triblock + diblock (85:15) |
| Kraton ® D 1133 | SBS + SB | 35 | triblock + diblock (66:34) |
| Kraton ® FG 1901 | SEBS | 30 | triblock (hydrogenated and functionally grafted with 1.7% of maleic anhydride. |
| Septon ® 1001 | SEP | 35 | Hydrogenated diblock |
| Vector ® 6030 | SB | 30 | Unsaturated diblock |
| Vector ® 8550 | SBS | 29 | Unsaturated triblock |
| Vector ® 2518P | SBS | 31 | Unsaturated triblock |
| Solprene ® 1430 | SB | 40 | Unsaturated diblock |

Note:
SEP denotes to styrene/ethylene/propylene copolymers
SEBS denotes to styrene/ethylene/butylene/styrene copolymers
SB denotes to styrene/butadiene copolymers
SBS denotes to styrene-butadiene-styrene copolymers It should be recognized that block copolymers are not the only polymers that can be used in embodiments of the invention. Other types of polymers also may be used. Homopolymers which are capable of effecting strong molecular interaction between polymeric chains can be used. One such example is butyl rubber, which can thicken oil due to its compatibility with oil and high molecular weight. Specifically, a polybutadiene polymer sold under the trademark of Solprene® S200, which is available from GIRSA Industrias Negromex, S.A.de C.V. (INSA), can be used. Other homopolymers capable of forming hydrogen bonding may include polyamide, polyester, etc.

The amount of a polymer present in a candle composition may range from about 2 wt. % to about 35 wt. %, although other composition range is acceptable. Preferably, a polymer is present in the candle composition from about 3 wt. % to about 30 wt. %. In embodiments where both a diblock copolymer and a triblock copolymer are used, the triblock copolymer may range from about 3 wt. % to about 30 wt. %, and the diblock copolymer from about 1 wt. % to about 20 wt. %.

In addition to a wax and a polymeric material, a hydrocarbon oil may be used in forming a polymeric candle composition. Hydrocarbon oil refers to any oil that is primarily composed of one or more compounds with hydrocarbon moieties. Suitable hydrocarbon oils include, but are not limited to, vegetable oil, silicone oil, animal oil, mineral oil, esters, or other oil-soluble liquids. It also includes refined, aromatic-free paraffinic and naphthenic oils, solvents, synthetic liquid, hydrogenated or unhydrogenated oligomers of polybutene, polypropylene, polydecene, and polyterpene. Other polyolefins also are suitable.

A preferred mineral oil is white oil which is colorless and transparent and generally is recognized as safe for contact with human skin. Another preferred hydrocarbon oil is poly-α-olefins ("PAOs"). The term "poly-α-olefin" refers to a class of saturated olefin oligomers. A typical poly-α-olefin includes various amounts of dimers, trimers, tetramers, pentamers, hexamers of an α-olefin. A preferred PAO is oligomers of 1-decene, although it may be oligomers of any other α-olefins.

In formulating a polymeric candle composition, the wax and polymer may be present in any amount so long as the resulting polymeric candle composition has a phase transition temperature above ambient temperature. In some embodiments, a polymeric candle composition may be made from the following components: a paraffin wax with at least 20 carbon atoms per molecule in an amount of about 2 to about 96% by weight; a block copolymer in an amount of about 2 to about 35 percent by weight; a PAO in an amount of 0 to about 96% by weight; and a white oil in the amount of 0 to about 96% by weight. Additional additives and objects may be included during the manufacturing of candles.

Candles in accordance with embodiments of the invention may be prepared by blending a hydrocarbon oil and a wax with one or more triblock, radial block, and/or multi-block copolymers, star polymers, or mixtures thereof, in desired amounts. A diblock copolymer may also be optionally included. In general, the higher the polymer content, the stiffer the gel.

In some embodiments, a hydrocarbon oil and a suitable wax are first heated to a temperature in the range of about 50° C. to about 150° C., at which point a polymer is added under agitation to the desired weight percent as set forth herein. After sufficient time for the copolymer to dissolve in the mixture, the composition is poured into a mold or ajar containing a wick. Alternatively, a wick may be added thereafter, and the composition is allowed to cool to a stiff gel.

Preferably, the candle is formed by cooling the polymeric candle composition in a mold or jar. A mold is used to impart external features, for example, a pillar candle, if desired. Conventional jars, clear, colored or otherwise decorative, such as sculpted, etched, cut glass, etc., may be employed for holding the candle. More preferably, clear glass jars are used for a jar candle.

Candles also may be formed by blending a suitable polymer (or a polymer blend) and a hydrocarbon oil and heating the mixture to a temperature in the range of from about 50° C. to about 150° C. to dissolve the polymer (or the polymer blend) in the oil. A wax is then added under agitation. The wax is mixed with the hydrocarbon oil and the copolymer. Mixing may be carried out in any conventional manner. Upon cooling, a stiff, opaque gel forms.

The candles employ a wick, typically of porous material which may be either waxed or unwaxed and of the thickness appropriate for the particular candle design. The wicks used are conventional and are well known in the art. The wick may include a decorative feature, for example, striping, coloring, impregnation or coated with material for special effects, such as to provide a colored flame, sparkles, etc., if so desired.

Candles in accordance with embodiments of the invention also may contain one or more additives such as stabilizers, anti-oxidants, colorants, fragrances, flame retardants, and the like to an extent not affecting or decreasing the desired properties of the candle. With respect to antioxidants, specific reference is made to 2,6-di-tert-butyl-4-methylphenol known as "BHT," which is generally employed at about 0.01 to about 1 weight percent. Other antioxidants also may be used.

Colorants may be added to the candles. The candles may be multicolored or have colored layers. The latter is achieved by forming one colored layer, allowing the layer to cool, and overlaying with a second colored layer, and so on. Other designs can be employed, such as single or multi-color swirls. Such swirls can be achieved by adding the color to the polymeric candle composition at a time during cooling of the composition but prior to complete gelation, and gently stirring the composition. Similar design variations will be readily apparent to those skilled in the art.

In addition to colorants, ornamental features may be embedded within the candle body. Such features may be either insoluble or soluble in the polymeric candle composition of the candle, as desired. Use of such ornamental features allows a possibility not heretofore available in decorative features, as virtually any decorative object can be incorporated within the candle body, provided generally that such decorative feature does not adversely affect the burning capacity of the candle in an undesired way.

Notwithstanding the above, decorative and other functional features that interfere with the burning of the candle may be incorporated, if so desired. For example, in suitable candle designs, decorative features located near the periphery of the candle and not in communication with the wick or flame will not adversely affect the operation of the candle and may thus be of any sort desired. Such a decorative feature may be placed in the candle, for example, by addition to the polymeric candle composition after sufficient cooling of the melt but before complete gelation.

Exemplary insoluble decorative features include stars, glitter, sparkles, ribbons, air bubbles of various size, etc. A pearlizing agent may be used in the candle. Other decorative additives, such as those that cause special effects, e.g., sparkling, flame coloring, etc., or mixtures thereof, also may be added to the polymeric candle composition of the candle in conventional amounts and as desired. In addition, fluorescent and phosphorescent pigments or dyes may be added to enhance the appearance of the candle. Similarly, candles with buried or hidden messages may be made. Since the candles are opaque at ambient temperature, the messages cannot be seen initially. After the candles are lit, the hidden messages become visible. Phrases, such as "Happy Birthday" and "Merry Christmas," may be included in the candles. Preferably, these decorative objects are suspended in the candle. Pending U.S. patent application Ser. No. 09/007,838, entitled "Hydrocarbon Gels as Suspending and Dispersing Agents and Products," filed Jan. 15, 1998, discloses a suspension system which can be used in embodiments of the invention. The disclosure of this patent application is incorporated by reference in its entirety herein.

Fragrances, for example, cinnamon, spice, bayberry, pine, essence oils, etc., also may be used in a manner similar to the way conventional wax candles employ pleasing aromatic additives. Any fragrances soluble in the composition may be used in making the candles. These fragrances can be employed by inclusion into the hydrocarbon oil. Alternatively, if the fragrance is particularly volatile, it is preferably added to the cooling composition prior to complete gelation. Fragrances are generally employed at up to about 20% by weight of the total polymeric candle composition. However, it is recognized by those skilled in the art that fragrant additives can be used up to their characteristic solubility level in the composition of the candle of the invention.

Candles in accordance with embodiments of the invention may further contain a functional additive, such as an insect repellant, for use in the same capacity as conventional candles containing such an additive. For example, U.S. Pat. No. 5,387,418 discloses one such insect repellant compound that may be employed in the candles. Citronella oil is another example of an insect repellant that may be used in embodiments of the invention. These additives are used in the conventional amounts as known in the art.

As an example of another functional additive, one may place a flame retardant in the candle, located at suitable location so as to automatically extinguish the candle at that location. Thus, if it is desired that the candle be self-extinguish at, for example, one inch from the bottom, a first layer of a polymeric candle composition including a flame retardant may be poured to the one inch height. After cooling of said first layer, a subsequent layer of the polymeric candle composition without the flame retardant can be layered over the first layer. In operation, the candle burns normally until reaching the area in which the flame retardant has been incorporated, at which point the candle self extinguishes. Flame retardants are known in the art and are used at conventional levels.

In preparation of the candles according to embodiments of the invention, where possible, additives are most preferably added to the hydrocarbon oil in the desired amount. Additives may also be added during mixing of the base candle composition or during cooling of the composition to form a gel.

EXAMPLES

The following examples illustrate embodiments of the invention, and are not intended to limit the scope of the invention otherwise described herein. Any numerical values described herein are approximate numbers.

The examples are described with respect to a number trade names when referring to a specific component. For example, Kraton® G1650, G1654, and G1651 are triblock copolymers available from Shell Chemical. Kraton® G1702 is a diblock copolymer available from Shell Chemical. Durasyn® 168 refers to a poly-α-olefin, i.e., PAO 8, available from BP Amoco. BHT (2,6-di-tert-butyl-4-methylphenol) is an antioxidant available from Ashland Chemical, Eastman Chemical, and Spectrum Chemical. The waxes used in all of the following examples were a paraffin wax with a melting point in the range of about 110° F. to about 125° F. The wax used was substantially free of hydrocarbons with less than 20 carbon atoms per molecule. An example of the paraffin wax was purchased from Bareco under the trade name of Bareco Paraffin 120/125. White oil may be obtained from Penreco under the trade name of Drakeol 21. Various candles were made according to the formulations in the following table. In some candles, a fragrance was added to enhance the smell of the candles. Any commercially available fragrance soluble in the composition may be used. It should be recognized that any generic equivalents of the aforementioned branded products may be used instead.

Formula 1

| Component | Weight Percent |
|---|---|
| Durasyn ® 168 (PAO 8) | 44.95 |
| White oil | 34.95 |
| Wax | 10 |
| Kraton ® G1650 (Triblock copolymer) | 8 |
| Kraton ® G1651 (Triblock copolymer) | 2 |
| BHT (Antioxidant) | 0.1 |

Formula 2

| Component | Weight Percent |
|---|---|
| Durasyn ® 168 (PAO 8) | 39.95 |
| White oil | 39.95 |
| Wax | 10 |
| Kraton ® G1650 (Triblock copolymer) | 8 |
| Kraton ® G1651 (Triblock copolymer) | 2 |
| BHT (Antioxidant) | 0.1 |

Formula 3

| Component | Weight Percent |
|---|---|
| White Oil | 82.33 |
| Kraton ® G1650 (Triblock copolymer) | 7.65 |
| Wax | 6 |
| Fragrance | 4 |
| BHT | 0.02 |

Formula 4

| Component | Weight Percent |
|---|---|
| White Oil | 69.52 |
| Kraton ® G1650 (Triblock copolymer) | 6.46 |
| Wax | 20 |
| Fragrance | 4 |
| BHT | 0.02 |

Formula 5

| Component | Weight Percent |
|---|---|
| Durasyn ® 168 (PAO 8) | 39.45 |
| White oil | 39.45 |
| Wax | 10 |
| Kraton ® G1650 (Triblock copolymer) | 8 |
| Kraton ® G1651 (Triblock copolymer) | 2 |
| Kraton ® G1702 (diblock copolymer) | 1 |
| BHT (antioxidant) | 0.1 |

Formula 6

| Component | Weight Percent |
|---|---|
| White oil | 70.9 |
| Wax | 20 |
| Kraton ® G1650 (Triblock copolymer) | 8 |
| Kraton ® G1702 (Diblock copolymer) | 1 |
| BHT (Antioxidant) | 0.1 |

Formula 7

| Component | Weight Percent |
|---|---|
| Wax | 80.0 |
| White oil | 9.1 |
| Kraton ® G1650 (Triblock copolymer) | 9.1 |
| Kraton ® G1651 (Triblock copolymer) | 1.8 |

Formula 8

| Component | Weight Percent |
|---|---|
| Wax | 96 |
| Kraton ® G1654 (Triblock copolymer) | 4 |

Formula 9

| Component | Weight Percent |
|---|---|
| Wax | 86 |
| White oil | 10 |
| Kraton ® G1654 (Triblock copolymer) | 4 |

Formula 10

| Component | Weight Percent |
|---|---|
| Wax | 79 |
| White oil | 11 |
| Kraton ® G1650 (Triblock copolymer) | 7.0 |
| Kraton ® G1651 (Triblock copolymer) | 3.0 |

Formula 11

| Component | Weight Percent |
|---|---|
| Wax | 88 |
| Kraton ® G1650 (Triblock copolymer) | 12 |

Formula 12

| Component | Weight Percent |
|---|---|
| Durasyn ® 168 (PAO 8) | 80 |
| White oil | 6.9 |
| Wax | 5 |
| Kraton ® G1650 (Triblock) | 8 |
| BHT (Antioxidant) | 0.1 |

Formula 13

| Component | Weight Percent |
|---|---|
| White oil | 59.98 |
| Wax | 10 |
| Kraton ® G1650 (Triblock) | 30 |
| BHT (Antioxidant) | 0.02 |

All candles made according to the above formulas were opaque at room temperature. After they were lit, the top portion of the candles slowly became transparent. After sufficient time elapsed, some of the candles became entirely transparent. All of the candles had a phase transition temperature above ambient temperature. While some candles had a phase transition temperature ranging from about 35° C. to about 38° C., other candles had a phase transition temperature in the range of about 40° C., 45° C. to about 60° C. It is possible that some candles may have a phase transition temperature exceeding 60° C.

Figure 2:
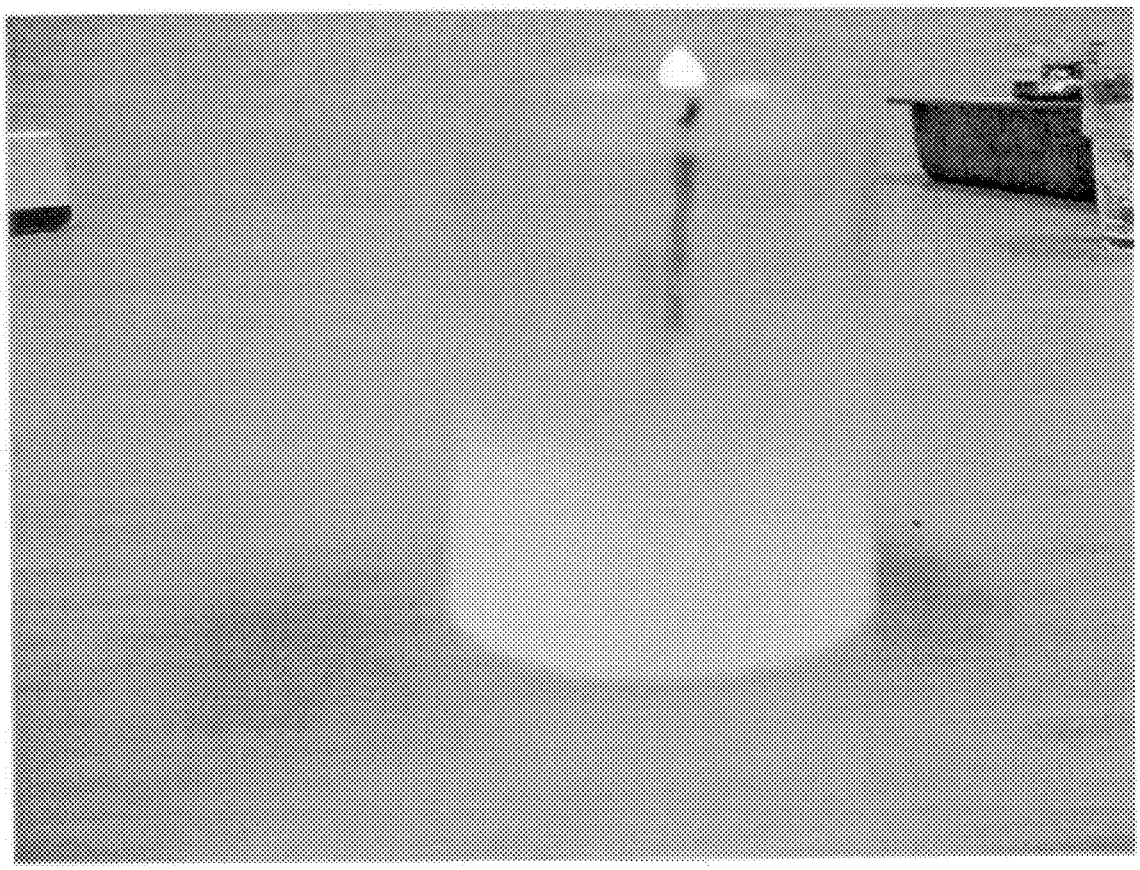
FIG. 2 is a photograph of the candle of FIG. 1 after it is lit. The photograph shows that the top portion of the candle is substantially transparent while the candle is lit.

FIGS. 1–2 are photographs of a candle which was made according to Formula 1. FIG. 1 is a photograph of the candle at room temperature before being lit. The photograph shows that the candle was opaque. After it was lit, the candle became substantially transparent as evidenced by FIG. 2. It can be seen from FIG. 2 that the top portion of the candle was substantially transparent. As the bottom portion of the candle was warmed up by the heat from the flame, the entire candle became substantially transparent.

Figure 3:
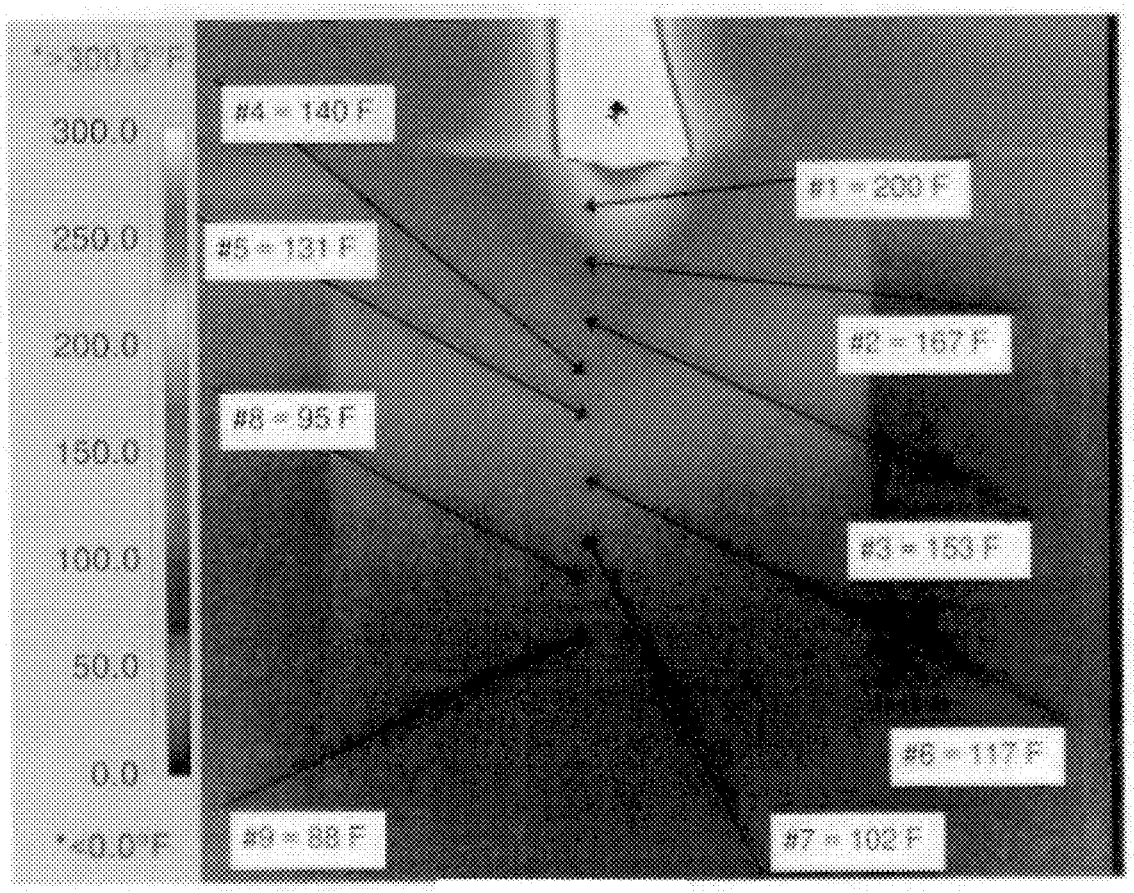
FIG. 3 is a temperature profile of the candle of FIG. 2 obtained by infrared thermography while the candle is lit.

FIG. 3 is a temperature profile of the above candle obtained by infrared thermography. While the candle was burning, the temperature of the candle body material ranged from about 200° F. (about 93° C.) to about 88° F. (about 31° C.). The temperature at the border between the opaque portion and the transparent portion was about 102° F. (about 38.9° C.). This temperature profile appears to indicate that the candle has a phase transition temperature in the vicinity of about 38.9° C., which is above the room temperature. Because the phase transition temperature is above the room temperature, the transition from an opaque candle to a transparent candle can be observed while the candle is lit.

Figure 4:
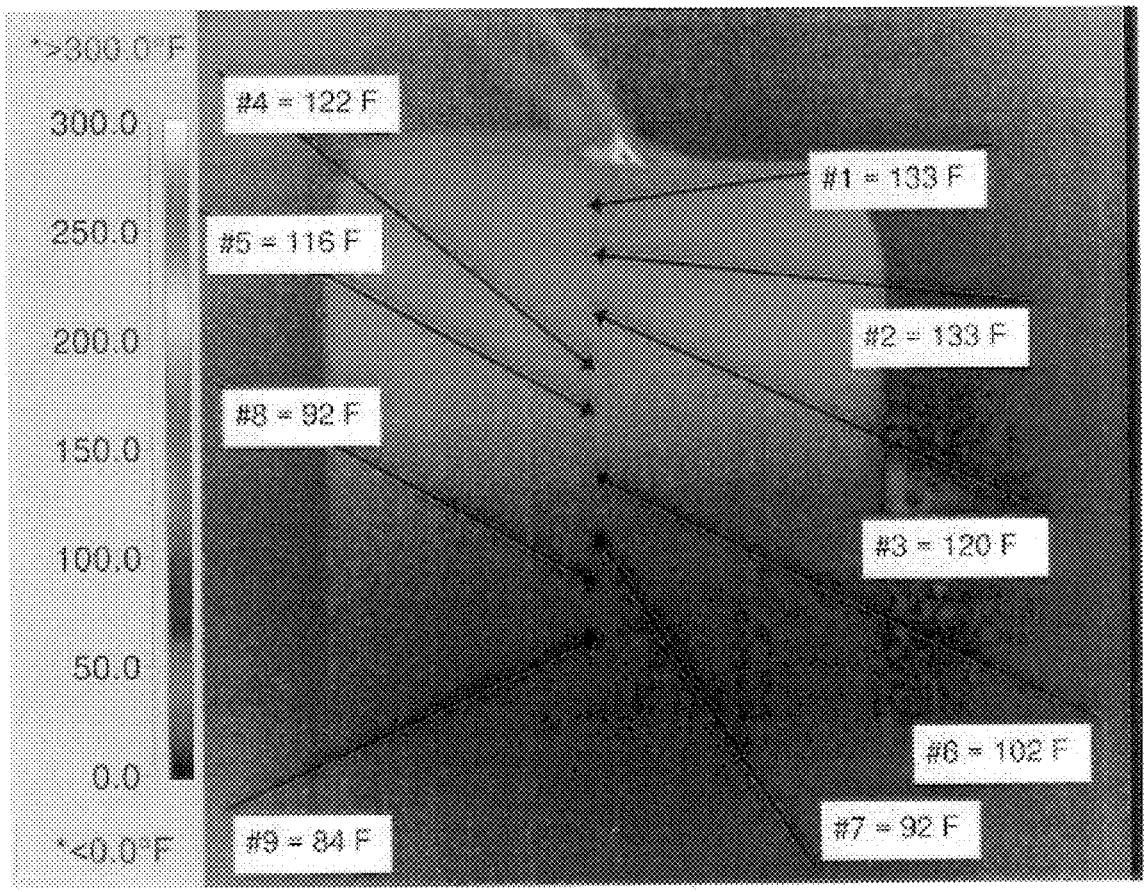
FIG. 4 is another temperature profile of the candle of FIG. 2 obtained by infrared thermography immediately after the candle is blown out.

FIG. 4 is another temperature profile of the candle immediately after it is blown out. As indicated by FIG. 4, the temperature range of the candle body material was from about 130° F. (about 55° C.) to about 84° F. (about 26.7° C.). Again, the temperature at the boundary between the opaque portion and the transparent portion was about 102° F. (about 38.9° C.). This spot was about 3 cm away from the wick. This is in contrast to FIG. 3 in which the phase boundary was about 3.5 cm away from the wick. This shows that the phase transition is reversible for the candle body material.

As demonstrated above, embodiments of the invention provide a polymeric candle which undergoes a phase transition from opaque to substantially transparent when being lit. In addition to its aesthetic appeal, such candles may be used as a temperature indicator. Because the phase transition temperature may be adjusted according to its composition, candles with varying phase transition temperatures may be manufactured. These candles provide an alternative to the traditional opaque candles and transparent candles. The candles may be free-standing or contained in a jar, thereby fulfilling various decorative needs.

While the invention has been described with respect to a limited number of embodiments, modifications and variations therefrom exist. For example, the wax material may be replaced by a synthetic polymer which is not considered as a wax so long as it is capable of undergoing a phase transition above the room temperature. Furthermore, the polymeric material used as a polymer also may be replaced by a comparable material which is capable of effectuating physical crosslinking. Although it is preferred that the candle composition has a phase transition temperature of about 35° C. or higher, it is entirely acceptable to make a candle composition with a phase transition temperature below 35° C. However, one practical limitation is that those candles must be put in a relatively cold environment in order to observe the phase transition. It should be understood that the application of the candle composition is not limited to making candles only. The polymeric candle composition also may be used in other applications which require the use of a wax. While a phase transition from opaque to transparent is preferred, a candle which undergoes a phase transition from translucent to transparent also may be manufactured in embodiments of the invention. The appended claims intend to cover all such variation and modifications as falling within the scope of the invention.

What is claimed is:

1. A candle composition for making a candle, comprising:

a wax; and a polymeric material, wherein the composition is characterized as having a phase transition temperature of about 35° C. or higher;

wherein the composition is substantially opaque at a temperature below the phase transition temperature, and at least a portion of the composition becomes substantially transparent at or above the phase transition temperature; and wherein the wax is substantially free of hydrocarbons having fewer than 20 carbon atoms per molecule and has a melting point of about 100° F. to about 200° F.

2. The candle composition of claim 1, wherein the phase transition temperature is about 38° C. or higher.

3. The candle composition of claim 1, wherein the phase transition temperature is about 40° C. or higher.

4. The candle composition of claim 1, wherein the phase transition temperature is about 45° C. or higher.

5. The candle composition of claim 1, further comprising a hydrocarbon oil.

6. The candle composition of claim 1, further comprising a mixture of white oil and a poly-α-olefin.

7. The candle composition of claim 1, further comprising white oil in the range of 0% to about 96% by weight.

8. The candle composition of claim 1, further comprising poly-α-olefin in the range of 0% to about 96% by weight.

9. The candle composition of claim 1, wherein the wax is a paraffin wax which is substantially free of hydrocarbons with less than 20 carbon atoms per molecule.

10. The candle composition of claim 9, wherein the wax has a melting point ranging from about 100° F. to about 200° F.

11. The candle composition of claim 9, wherein the wax has a melting point ranging from about 100° F. to about 170° F.

12. The candle composition of claim 9, wherein the wax has a melting point ranging from about 110° F. to about 125° F.

13. The candle composition of claim 8, wherein the amount of the wax is in the range of about 2% to about 96% by weight.

14. The candle composition of claim 1, wherein the polymeric material is selected from one or more of di-block copolymers, tri-block copolymers, radial block copolymers, star polymers, and multi-block copolymers.

15. The candle composition of claim 1, wherein the polymeric material is a block copolymer with a rigid block and an elastomeric block.

16. The candle composition of claim 15, wherein the block copolymer is selected from the group consisting of polystyrene/ethylene-propylene copolymer, polystyrene/ethylene-butadiene copolymer, and polystyrene/butadiene copolymer.

17. The candle composition of claim 15, wherein the block copolymer is selected from the group consisting of polystyrene/polyester, polyether/polyamide, polyether/polyester, polyester/polyamide, polyether/polyurethane, polyester/polyurethane, poly(ethylene oxide)/poly (propylene oxide), nylon/rubber, and polysiloxane/polycarbonate.

18. The candle composition of claim 15, wherein the block copolymer has about 2 wt. % to about 80 wt. % rigid blocks.

19. The candle composition of claim 15, wherein the block copolymer has about 20 wt. % to about 40 wt. % rigid blocks.

20. The candle composition of claim 15, wherein the rigid block is selected from the group consisting of polystyrene, polyethylene, polyvinylchloride, and phenolics.

21. The candle composition of claim 15, wherein the elastomeric block is selected from the group consisting of ethylene/butadiene copolymer, polyisoprene, polybutadiene, ethylene/propylene copolymer, and ethylene-propylene/diene copolymer.

22. The candle composition of claim 14, wherein the polymeric material is a triblock copolymer comprising polystyrene as a rigid block.

23. The candle composition of claim 14, wherein the polymeric material is a triblock coploymer comprising ethylene/propylene copolymer, polybutadiene, ethylene/butadiene copolymer, or polyisoprene as an elastomeric block.

24. The candle composition of claim 14, wherein the polymeric material is a mixture of a triblock copolymer and a diblock.

25. The candle composition of claim 1, wherein the polymeric material is a homopolymer capable of forming hydrogen bonding.

26. The candle composition of claim 25, wherein the homopolymer is polyamide or polyester.

27. The candle composition of claim 1, the amount of the polymeric material is in the range of about 2% to about 35% by weight.

28. The candle composition of claim 1, further comprising one or more additives.

29. The candle composition of claim 28, wherein the additives are selected from the group consisting of colorants, anti-oxidants, fragrances, flame-retardants, and insect repellants.

30. The candle composition of claim 1, further comprising one or more decorative objects.

31. The candle composition of claim 1, wherein the phase transition is reversible.

32. A candle, comprising:

a wax; and a polymeric material, wherein the candle is characterized as having a phase transition temperature of about 35° C. or higher;

wherein the candle is substantially opaque at a temperature below the phase transition temperature, and at least a portion of the candle becomes substantially transparent at or above the phase transition temperature; and wherein the wax is substantially free of hydrocarbons having fewer than 20 carbon atoms per molecule and has a melting point of about 100° F. to about 200° F.

33. The candle of claim 32, wherein the phase transition temperature is about 38° C. or higher.

34. The candle of claim 32, wherein the phase transition temperature is about 40° C. or higher.

35. The candle of claim 32, wherein the phase transition temperature is about 45° C. or higher.

36. The candle of claim 32, further comprising a hydrocarbon oil.

37. The candle of claim 32, further comprising a mixture of white oil and a poly-α-olefin.

38. The candle of claim 32, further comprising white oil in the range of 0% to about 96% by weight.

39. The candle of claim 32, further comprising poly-α-olefin in the range of 0% to about 96% by weight.

40. The candle of claim 32, wherein the wax is a paraffin wax which is substantially free of hydrocarbons with less than 20 carbon atoms per molecule.

41. The candle of claim 40, wherein the wax has a melting point ranging from about 100° F. to about 200° F.

42. The candle of claim 40, wherein the wax has a melting point ranging from about 100° F. to about 170° F.

43. The candle of claim 40, wherein the wax has a melting point ranging from about 110° F. to about 125° F.

44. The candle of claim 32, wherein the amount of the wax is in the range of about 2% to about 96% by weight.

45. The candle of claim 32, wherein the polymeric material is selected from one or more of di-block copolymers, tri-block copolymers, radial block copolymers, star polymers, and multi-block copolymers.

46. The candle of claim 32, wherein the polymeric material is a block copolymer with a rigid block and an elastomeric block.

47. The candle of claim 46, wherein the block copolymer is selected from the group consisting of polystyrene/ethylene-propylene copolymer, polystyrene/ethylene-butadiene copolymer, and polystyrene/butadiene copolymer.

48. The candle of claim 46, wherein the block copolymer is selected from the group consisting of polystyrene/polyester, polyether/polyamde, polyether/polyester, polyester/polyamide, polyether/polyurethane, polyester/polyurethane, poly(ethylene oxide)/polypropylene oxide), nylon/rubber, and polysiloxane/poly carbonate.

49. The candle of claim 46, wherein the block copolymer has about 2 wt. % to about 80 wt. % rigid blocks.

50. The candle of claim 46, wherein the block copolymer has about 20 wt. % to about 40 wt. % rigid blocks.

51. The candle of claim 46, wherein the rigid block is selected from the group consisting of polystyrene, polyethylene, polyvinylchloride, and phenolics.

52. The candle of claim 46, wherein the elastomeric block is selected from the group consisting of ethylene/butadiene copolymer, polyisoprene, polybutadiene, ethylene/propylene copolymer, and ethylene-propylene/diene copolymer.

53. The candle of claim 45, wherein the polymeric material is a triblock copolymer comprising polystyrene as a rigid block.

54. The candle of claim 45, wherein the polymeric material is a triblock coploymer comprising ethylene/propylene copolymer, polybutadiene, ethylene/butadiene copolymer, or polyisoprene as an elastomeric block.

55. The candle of claim 45, wherein the polymeric material is a mixture of a triblock copolymer and a diblock.

56. The candle of claim 32, wherein the polymeric material is a homopolymer capable of forming hydrogen bonding.

57. The candle of claim 56, wherein the homopolymer is polyamide or polyester.

58. The candle of claim 32, the amount of the polymeric material is in the range of about 2% to about 35% by weight.

59. The candle of claim 32, further comprising one or more additives.

60. The candle of claim 59, wherein the additives are selected from the group consisting of colorants, antioxidants, fragrances, flame-retardants, and insect repellants.

61. The candle of claim 32, wherein the phase transition is reversible.

62. The candle of claim 32, further comprising a wick.

63. The candle of claim 32, further comprising an ornamental object inside the candle.

64. The candle of claim 32, wherein the candle is free-standing.

65. The candle of claim 32, further comprising a jar or container.

66. A candle, comprising:

a paraffin wax in the range of about 2% to about 96% by weight, the paraffin wax comprising substantially hydrocarbons with at least 20 carbon atoms per molecule;

a polymeric material in the range of about 2% to about 35% by weight, the polymeric material being selected from the group consisting of di-block copolymers, tri-block copolymers, radial block copolymers, star polymers, and copolymers having four or more blocks, the polymeric material capable of effecting physical cross-linking;

a poly-α-olefin in the range of 0% to about 96% by weight; and a white oil in the range of 0% to about 96% by weight, wherein the candle is characterized as having a phase transition temperature of about 38° C. or higher;

wherein the candle is substantially opaque at a temperature below the phase transition temperature, and at least a portion of the candle becomes substantially transparent at or above the phase transition temperature; and wherein the wax is substantially free of hydrocarbons having fewer than 20 carbon atoms per molecule and has a melting point of about 100° F. to about 200° F.

67. A method of making a candle, comprising:

providing a wax and a polymeric material;

mixing the wax and the polymeric material to form a candle composition; and forming a candle from the candle composition, wherein the candle is characterized as having a phase transition temperature of about 35° C. or higher;

wherein the candle is substantially opaque at a temperature below the phase transition temperature, and at least a portion of the candle becomes substantially transparent at or above the phase transition temperature; and wherein the wax is substantially free of hydrocarbons having fewer than 20 carbon atoms per molecule and has a melting point of about 100° to about 200° F.

68. A method of making a candle composition, comprising:

providing a wax and a polymeric material; and mixing the wax and the polymeric material to form a candle composition, wherein the composition is characterized as having a phase transition temperature of about 35° C. or higher;

wherein the composition is substantially opaque at a temperature below the phase transition temperature, and at least a portion of the composition becomes substantially transparent at or above the phase transition temperature; and wherein the wax is substantially free of hydrocarbons having fewer than 20 carbon atoms per molecule and has a melting point of about 100° F. to about 200° F.

* * * * *